United States Patent [19]

Lam

[11] Patent Number: 4,639,324

[45] Date of Patent: Jan. 27, 1987

[54] LUBRICATING COMPOSITIONS

[75] Inventor: William Y. Lam, Ballwin, Mo.

[73] Assignee: Ethyl Petroleum Additives, Inc., St. Louis, Mo.

[21] Appl. No.: 752,509

[22] Filed: Jul. 8, 1985

[51] Int. Cl.[4] ..... C16M 129/68

[52] U.S. Cl. ..... 252/48.6; 260/399

[58] Field of Search ..... 252/48.6; 260/399

[56] References Cited

U.S. PATENT DOCUMENTS

| | | | |
|---|---|---|---|
| 3,523,926 | 8/1970 | Mirviss | 260/79 |
| 3,586,700 | 6/1971 | Kurtz et al. | 260/327 |
| 3,882,031 | 5/1975 | Askew et al. | 252/45 |
| 3,926,822 | 12/1975 | Habiby | 252/48.6 |
| 4,147,640 | 4/1979 | Jayne et al. | 252/45 |
| 4,149,982 | 4/1979 | Lee et al. | 252/48.6 |
| 4,166,797 | 9/1979 | Recchuite | 252/48.6 |
| 4,188,297 | 2/1980 | Jayne et al. | 252/45 |
| 4,328,112 | 5/1982 | Vis et al. | 252/48.6 |

*Primary Examiner*—William R. Dixon, Jr.
*Assistant Examiner*—Cynthia A. Prezlock
*Attorney, Agent, or Firm*—Donald L. Johnson; John F. Sieberth; W. G. Montgomery

[57] ABSTRACT

Lubricating oils having improved antioxidant and antiwear properties are obtained by adding a minor amount of a reaction product made by reacting at least one aliphatic olefinically unsaturated hydrocarbon containing from about 8 to 36 carbon atoms (preferably an α-olefin) concurrently with sulfur and at least one fatty acid ester (preferably an oil such as cottonseed oil) to obtain a reaction intermediate and reacting this intermediate with additional sulfur and a dimer of cyclopentadiene or lower $C_{1-4}$ alkyl substituted cyclopentadiene dimers, such as methylcyclopentadiene dimer.

72 Claims, No Drawings

LUBRICATING COMPOSITIONS

BACKGROUND OF THE INVENTION

This invention relates to sulfurized products having utility as lubricant additives and lubricating compositions containing them. The invention also relates to a process for preparing sulfurized products, the products so prepared and lubricating compositions containing such products.

Antioxidant additives used in lubricating oils, particularly, but not exclusively, automotive lubricants, require a combination of properties which is difficult to meet in practice. Such additives must, of course, impart a high degree of resistance to oxidation to the lubricant, but in addition must be reasonably inexpensive, must be compatible with various other additives commonly used in lubricants, must have adequate thermal stability and must satisfy various other criteria of suitability, such as the ability to protect copper-lead bearings from corrosion. Very many different types of antioxidants have been proposed, and in some cases have been commercially used on a comparatively small scale. However, for many years the type of antioxidants which have been very widely used as the most suitable general purpose antioxidants for automotive and other lubricants are metal, particularly zinc salts of di-hydrocarbyl dithiophosphoric acids.

However, the need for lubricant developments to keep pace with engine developments have given rise recently to difficulties in the use of metal dithiophosphate salts as anti-oxidants. The metal content of these additives is a source of ash and there is a growing tendency for the quality standards laid down by manufacturers and other interested organizations to specify low-ash lubricant formulations for modern engines. Attempts have been made to develop dithiophosphate derivatives, which do not contain metal, in order to meet these requirements. However, such developments have been forestalled, at least to some extent, by yet another development in engine design, namely, the use of catalytic devices in engine exhausts to minimize pollution caused by vehicle emissions. The catalysts used in such devices are sensitive to phosphorus compounds and can become poisoned and ineffective if exposed to such compounds. Consequently, the need has arisen for antioxidants which do not contain metal or phosphorus and yet still meet all the requirements for antioxidants formerly satisfied by the metal dithiophosphates.

Sulfurized norbornenyl compounds are known and are reported by Kurtz et al., U.S. Pat. No. 3,586,700. Vulcanizing agents made by reaction of sulfur with diolefins such as dicyclopentadiene are reported by Mirviss, U.S. Pat. No. 3,523,926. German Pat. No. 658,128 discloses the reaction of unsaturated aliphatic compounds such as rubber with sulfur and hydrogen sulfide. Sulfurized dicyclopentadiene lubricant additives are described in U.S. Pat. No. 3,882,031 and lubricant additives having antioxidant and antiwear properties made by reacting an olefin such as dicyclopentadiene with sulfur and a mercaptan are reported in U.S. Pat. No. 4,188,297. U.S. Pat. No. 4,147,640 discloses sulfurized products suitable for use in lubricating oils as antioxidants and antiwear agents obtained by reacting an olefinic hydrocarbon containing about 6–18 carbon atoms and about 1–3 olefinic double bonds with sulfur and hydrogen sulfide to obtain a reaction intermediate and reacting the intermediate so formed with additional olefin hydrocarbon. Preferred olefinic hydrocarbons are dicyclopentadiene and alloocimene. U.S. Pat. No. 3,926,822 discloses sulfurized lubricant additives made by sulfurizing a mixture of at least one fatty acid ester, at least one $C_{8-36}$ aliphatic olefin, and, optionally, at least one fatty acid.

DESCRIPTION OF THE PREFERRED EMBODIMENTS

A preferred embodiment of this invention is a lubricating oil additive prepared by the process comprising:

(A) reacting, at about 140°–180° C., a mixture comprising 100 parts by weight of at least one aliphatic olefinically unsaturated hydrocarbon containing from about 8 to 36 carbon atoms and about 1 to 160 parts by weight of at least one fatty acid ester with elemental sulfur to obtain an intermediate, and (B) reacting, at about 110°–140° C., said intermediate with additional sulfur and from about 25 to 100 parts by weight based on the total weight of combined said aliphatic olefinically unsaturated hydrocarbon and fatty acid ester, a dimer of cyclopentadiene or lower $C_{1-4}$ alkyl substituted cyclopentadiene dimers.

The olefinic hydrocarbons used in the initial stage may be any aliphatic olefinic hydrocarbon which contains an olefinic double bond which is reactive with sulfur and the fatty acid ester reagents of the invention and can be made compatible with lubricating environments. This is readily determined by merely mixing sulfur and fatty acid ester with the olefin under reaction conditions. The olefinic double bond may or may not be terminal in the hydrocarbon chain. The olefin may also be polyunsaturated. Terminal olefins or $\alpha$-olefins are preferred, especially those in the $C_{10}$–$C_{20}$ range. Mixtures of these olefins are commercially available and such mixtures are contemplated for use in this invention. Examples of highly preferred olefinically unsaturated hydrocarbons include 1-decene, 1-dodecene, 1-tetradecene, 1-hexadecene, 1-octadecene, eicosene and mixtures thereof.

As previously described, a mixture of the olefinic hydrocarbon reactant and at least one fatty acid ester is sulfurized in the initial stage of the process. The term "fatty acid" as used herein refers to acids which may be obtained by the hydrolysis of a naturally occurring vegetable or animal fat or oil. These are usually in the $C_{16}$ to $C_{20}$ range and include palmitic acid, stearic acid, oleic acid, linoleic acid and the like.

Fatty acid esters which are useful are primarily those with aliphatic alcohols, including monohydric alcohols such as methanol, ethanol, n-propanol, isopropanol, the butanols, etc., and polyhydric alcohols including ethylene glycol, propylene glycol, trimethylene glycol, neopentenyl glycol, glycerol and the like. Particularly preferred are the fatty oils, that is, naturally occurring esters of glycerol with the above-noted long chain carboxylic acids and synthetic esters of similar structure. Still more preferred are fatty oils derived from unsaturated acids, especially oleic and linoleic, including such naturally occurring animal and vegetable oils as lard oil, peanut oil, cottonseed oil, soybean oil, corn oil and the like. In general, about 1 to 160 parts, usually about 30 to 160 parts, and preferably about 40 to 120 parts of fatty acid ester per 100 parts of olefinic reactant are to be used in the initial reaction.

The weight ratio of combined fatty acid ester and olefinic reactants to sulfur can vary widely. In general, the weight ratio of combined ester and olefin to sulfur is between about 100:10 and 100:65, preferably between about 100:15 and 100:50.

The initial sulfurization reaction is effected by merely heating the aforedescribed reactants, usually with agitation and in an inert atmosphere (e.g. nitrogen). If any of the reagents, as, for example, the olefinic hydrocarbons, are appreciably volatile at the reaction temperature, the reaction vessel may be sealed and maintained under pressure.

The initial stage should be conducted at a temperature high enough to cause reaction, but not so high as to cause degradation of the reactants or products. A useful temperature range is about 140°–180° C. A preferred range is about 155°–165° C.

Reaction time is not an independent variable and depends on reaction conditions. The initial reaction should be conducted until the sulfurization is substantially complete as evidenced by the disappearance of sulfur. Good results are generally obtained in about 2 to 4 hours.

Following the initial stage of the reaction, the second stage is carried out. In the second stage additional sulfur and a dimer of cyclopentadiene or lower $C_{1-4}$ alkyl substituted cyclopentadiene dimers, such as methylcyclopentadiene dimer is added to the reaction product mixture obtained from the initial stage and the mixture is heated to cause further reaction.

The amount of cyclopentadiene dimer or lower $C_1$–$C_4$ alkyl substituted cyclopentadiene dimer used in the second stage of the reaction can range from about 25 to 100 parts by weight of dimer based on the combined weight of the olefinic hydrocarbon and fatty acid ester reactants employed in the initial stage of the process.

The amount of sulfur added in the second stage of the process can vary widely. Typically, from about 20 to 100 parts by weight and preferably from about 25 to 75 parts by weight of sulfur based on 100 parts of the dimer reactant employed in the second stage are used in the second step of the process. It is frequently advantageous to add the sulfur reactant portionwise to the mixture of the other reagents in the second stage of the process.

The second stage should be carried out at an elevated temperature sufficient to cause reaction to occur but not so high as to cause insoluble materials to form. The optimum temperature will vary somewhat with the materials used. In general, however, a reaction temperature above about 100° C. is desirable. A useful range is about 110° to 140° C. A preferred range is about 120°–130° C.

The second reaction stage should be conducted for a time adequate to maximize the formation of an oil-soluble non-corrosive product. At higher temperatures a shorter reaction time is used than at lower temperatures. Reaction times of from about 0.5 to 2 hours are useful. A preferred range is about 30 minutes to 1 hour.

A sulfurization catalyst of the type commonly used in sulfurization reactions is preferably used in the second stage. These are well-known catalysts and include quaternary ammonium salts, guanidines, thiuram sulfides and disulfides, sodium dialkyl-dithiocarbamates, alkyl and cycloalkyl amines, such as n-butylamine, di-n-butylamine, n-octylamine, triethylamine, diisopropylamine, dicyclohexamine and cyclohexylamine. Other catalysts include diethanolamine
triethanolamine
diphenyl guanidine
tetramethyl thiuram sulfide
tetramethyl thiuram disulfide
dipentamethylene thiuram tetrasulfide
cyclohexylethylamine
piperidine
benzyl trimethylammonium hydroxide
sodium dibutyl dithiocarbamate, and the like.

Preferred catalysts are the alkyl amines such as methylamine, dimethylamine, ethylamine, diethylamine, 2-ethylhexylamine, dodecylamine, hexadecylamine, eicosylamine and the like.

Particularly preferred amines are the tert-alkyl primary amines. Such amines are available commercially such as Primene JM-T and Primene 81-R (registered Trademark Rohm and Haas). These are mixtures of tert-alkyl primary amines the former containing about 18–22 carbon atoms per molecule and the latter containing about 12–14 carbon atoms per molecule.

It has also been found that 2,5-dimercapto-1,3,4-thiadiazole, 2,5-bis(t-octyldithio)-1,3,4-thiadiazole and 2-(t-dodecyldithio)-5-mercapto-1,3,4-thiadiazole may be employed in the second stage with particular advantage.

Accordingly, another preferred catalyst for use in the second stage is a thiadiazole having the formula

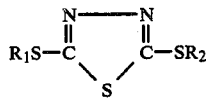

wherein $R_1$ and $R_2$ are independently selected from hydrogen or $-SR_3$, wherein $R_3$ is alkyl (e.g. methyl, tert-octyl, tert-dodecyl and the like).

A most preferred catalyst is a combination of an amine, especially Primene 81-R, and a thiadiazole derivative, such as, for example, 2,5-dimercapto-1,3,4-thiadiazole.

The amount of catalyst conventionally used is small, generally from about 0.1–20 percent, preferably about 0.1 to 10 percent, and most preferably from about 0.2 to 2 percent based on the total weight of all of the reactants employed in both the initial and second stages of the process.

Solvents are not required in either the initial or second-stage reaction. However, inert solvents such as neutral mineral oil, process oil, dimethylformamide, toluene, petroleum ether (80°–100° C.) and the like can be used, if desired.

The following examples illustrate the manner of preparing additives of the invention.

EXAMPLE I

In a reaction vessel fitted with a mechanical stirrer, condenser and thermometer was placed 44.8 grams of commercial $C_{14-16}$ mixed α-olefins, 28.0 grams of cottonseed oil and 33.0 grams of sulfur. The mixture was stirred while being heated gradually to 160°–165° C. The mixture was maintained at this temperature for approximately 2 hours. The resulting solution was then cooled to 120° C. and maintained at this temperature while an additional 28.5 grams of sulfur, 39.2 grams of dicyclopentadiene and 1.0 gram of Primene 81-R and 1.0 gram of 2,5-dimercapto-1,3,4-thiadiazole were added to the solution. The addition was complete within approximately 20 minutes. The resulting mixture was held at 120°–125° C. for 20 minutes. Vacuum (24 in.

Hg) was applied to the reaction system for about 15 minutes and heating was discontinued. Vacuum was broken at about 100° C. and a viscous product analyzing 33–35% sulfur was recovered.

EXAMPLE 2

In a reaction vessel fitted with a mechanical stirrer, condenser and thermometer was placed a mixture of 44.8 grams of commercial $C_{14-16}$ mixed α-olefins, 28.0 grams of cottonseed oil and 10.9 grams of sulfur. The mixture was stirred while it was heated gradually to 160° C. The mixture was held at this temperature for 1.5 hours. The resulting solution was then cooled and maintained at 120° C. while an additional 29.0 grams of sulfur, 39.2 grams of dicyclopentadiene, 1.0 gram of Primene 81R and 1.0 gram of 2,5-dimercapto-1,3,4-thiadiazole were added to the solution. The addition was complete in approximately ten minutes. The resulting mixture was held at 120°–130° C. for 30 minutes. Vacuum (26 in. Hg) was then applied to the reaction system for about 20 minutes and a viscous product analyzing 26% sulfur was recovered.

EXAMPLE 3

This example was conducted similar to Example 1 except that 39.2 grams of $C_{14-16}$ mixed α-olefins and 33.6 grams of cottonseed oil were used in the initial reaction stage. In the second stage, 28.5 grams of sulfur, 39.2 grams of dicyclopentadiene, 1.0 gram of Primene 81R and 1.0 gram of 2,5-dimercapto-1,3,4-thiadiazole were added. The product contained about 35% sulfur.

EXAMPLE 4

This example was conducted similar to Example 1 except that 37.5 grams of $C_{14-16}$ mixed α-olefins, 60 grams of cottonseed oil, and 14.4 grams of sulfur were used in the initial reaction stage and 25.8 grams of sulfur, 52.5 grams of dicyclopentadiene, 1.3 grams of Primene 81R and 0.7 gram of 2,5-dimercapto-1,3,4-thiadiazole were used in the second stage. The product contained about 21% sulfur.

EXAMPLE 5

This example was conducted similar to Example 1 except that 16.8 grams of cottonseed oil and 11.2 grams of vegetable oil residue were used in the initial reaction stage. In the second stage, 28.5 grams of sulfur, 39.2 grams of dicyclopentadiene, 1.0 gram of Primene 81R and 1.0 gram of 2,5-dimercapto-1,3,4-thiadiazole were used. The product contained about 35% sulfur.

EXAMPLE 6

This example was conducted similar to Example 1 except that 44.8 grams of commercial $C_{15-18}$ mixed α-olefins and 24.3 grams of sulfur were used in the initial reaction and 13.7 grams of sulfur were used in the second stage of sulfurization. The product contained about 25% sulfur.

EXAMPLE 7

This example was conducted similar to Example 1 except that 44.8 grams of commercial $C_{15-18}$ mixed α-olefins and 18.2 grams of sulfur were used in the initial reaction stage and 10.5 grams of sulfur were used in the second stage of sulfurization. The product contained about 20% sulfur.

Tests were carried out to demonstrate the beneficial properties of the new additives. One test is referred to as the 4-ball EP test (ASTM D2783) in which an EN-31 steel ball is rotated in loaded contact with three fixed similar balls. The contact is lubricated with a mineral oil (SAE 90) containing sufficient additive to provide 0.5 weight percent sulfur from the test additive. The test oil is subjected to a series of tests of ten seconds durations at increasing loads until weld occurs. Test criteria are the weld point and the load-wear index (LWI), an index of the ability of a lubricant to prevent wear at applied loads.

Results are given in the following Table 1:

TABLE I

| Additive | Weld Pt. (kg) | LWI (kg) |
|---|---|---|
| None | 80 | 16.6 |
| Example 1 | 315 | 50.7 |
| Example 2 | 315 | 50.1 |
| Example 3 | 315 | 52.1 |
| Example 4 | 315 | 46.8 |
| Example 5 | 315 | 51.8 |
| Example 6 | 250 | 44.6 |
| Example 7 | 250 | 42.1 |

A second test used was the 4-ball wear test (ASTM D2266) in which an EN-31 steel ball under 20 kg load is rotated gainst three fixed similar balls at 130° F. for one hour. The contact is lubricated with a mineral oil (SAE 90) containing sufficient additive to provide 0.5 weight percent sulfur from the test additive. The wear scars of the balls are then measured.

Results are given in the following Table 2:

TABLE 2

| Additive | Wear Scar (mm) |
|---|---|
| None | 0.80 |
| Example 1 | 0.54 |
| Example 2 | 0.48 |
| Example 3 | 0.58 |
| Example 4 | 0.43 |
| Example 5 | 0.56 |
| Example 6 | 0.46 |
| Example 7 | 0.47 |

A third test was the Timken OK load test (ASTM 2782). In this test a steel block bears against a rotating cap lubricated with a test oil containing sufficient additive to provide 0.5 weight percent sulfur in the oil for 10 minutes. The OK load is the maximum load in which no scoring or seizure occurs.

Results are given in the following Table 3:

TABLE 3

| Additive | OK Load (lb) |
|---|---|
| None | 8 |
| Example 1 | 50 |
| Example 2 | 50 |
| Example 4 | 50 |

The corrosiveness of the new additive toward copper was determined by the Copper Corrosion Test in which a freshly polished copper strip (2 ¾"×5/8"×1/20") is placed in a 1" test tube containing 30 grams of the test additive and is heated at 121° C. for three hours. The copper strip is then removed from the oil, cleaned by whipping off loose corroded material, washed with 10% KCN solution, water and acetone. The copper strip weight loss is then determined.

Results are given in the following Table 4:

TABLE 4

| Additive | Copper Weight Loss (mg) |
|---|---|
| Example 1 | 0.3 |
| Example 2 | 0.4 |
| Example 3 | 1.2 |
| Example 4 | 0.8 |
| Example 5 | 1.1 |
| Example 6 | 0.4 |
| Example 7 | 0.5 |

The additives are useful in lubricating oil compositions. This includes both mineral lubricating oil and synthetic lubricating oil such as olefin oligomers (i.e., decene-1 trimer), alkylated benzenes (e.g., octadecylbenzene) esters (e.g., di-2-ethylhexyladipate) and the like.

In lubricating oil compositions the additives are generally used in conjunction with other conventional oil additives such as neutral and overbased calcium or magnesium alkaryl sulfonates, phosphorosulfurized terpenes, phosphorosulfurized polyisobutylene, metal salts of phosphorosulfurized polyisobutylene, polyisobutyl succinimide of ethylene polyamines, polyisobutylphenol Mannich amine dispersants, N-alkylphenyl naphthylamine antioxidants, phenolic antioxidants such as 4,4'-methylene bis(2,6-di-tert-butylphenol) or N,N-dimethyl-3,5-di-tert-butyl-4-hydroxybenzyl amine and the like. Commercial lubricating oil conventionally contains a zinc dialkyldithiophosphate. When using the additives of the present invention, the amount of the zinc additive can be greatly reduced giving a low ash or no ash lubricant formulation.

In addition to crankcase lubricating oils, the additives of the present invention may also be useful in gear oils, transmission fluids, greases and the like.

The amount of the present additives used in lubricant compositions can vary from about 0.05 parts to 20 parts of additive based on 100 parts of oil.

The additives can be formulated in the concentrates or packages which contain other conventional additives in proper amount such that when a dosage of the concentrate is added to lubricating oil all the required additives are required at one time.

I claim:

1. A lubricating oil additive prepared by the process comprising:

(A) in a first stage reacting at about 140°–180° C. a mixture comprising 100 parts by weight of at least one aliphatic olefinically unsaturated hydrocarbon containing from about 8 to 36 carbon atoms and about 1 to 160 parts by weight of at least one fatty acid ester with elemental sulfur to obtain an intermediate, and (B) in a second stage reacting at about 110°–140° C., said intermediate with additional sulfur and from about 25 to 100 parts by weight based on the total weight of combined said aliphatic olefinically unsaturated hydrocarbon and said fatty acid ester, a dimer of cyclopentadiene or lower $C_{1-4}$ alkyl substituted cyclopentadiene dimer.

2. An additive of claim 1 wherein said olefinically unsaturated hydrocarbon is a monoolefinically unsaturated hydrocarbon.

3. An additive of claim 2 wherein said monoolefinically unsaturated hydrocarbon is an α-olefin containing about 8 to 36 carbon atoms.

4. An additive of claim 3 wherein said monoolefinically unsaturated hydrocarbon is at least one $C_{10-20}$ α-olefin.

5. An additive of claim 4 wherein said monoolefinically unsaturated hydrocarbon is a mixture of $C_{14-16}$ α-olefins.

6. An additive of claim 5 wherein said monoolefinically unsaturated hydrocarbon is a commercial mixture of $C_{14-16}$ α-olefins.

7. An additive of claim 1 wherein said fatty acid ester is a fatty acid ester of a monohydric alcohol.

8. An additive of claim 1 wherein said fatty acid ester is a fatty acid ester of a polyhydric alcohol.

9. An additive of claim 8 wherein said fatty acid ester is at least one fatty oil.

10. An additive of claim 9 wherein said oil is cottonseed oil.

11. An additive of claim 1 wherein said fatty acid ester is present in an amount of from about 40 to 120 parts of fatty acid ester per 100 parts of said olefinically unsaturated hydrocarbon.

12. An additive of claim 1 wherein the weight ratio of combined olefinically unsaturated hydrocarbon and fatty acid ester to sulfur in step (A) is between about 100:1 and 100:65.

13. An additive of claim 1 wherein said lower $C_{1-4}$ alkyl substituted cyclopentadiene dimer is methylcyclopentadiene dimer.

14. An additive of claim 1 wherein said dimer of cyclopentadiene or said lower $C_{1-4}$ cyclopentadiene dimer is present in an amount of from about 25 to 100 parts by weight of dimer based on the combined weight of said olefinically unsaturated hydrocarbon and said fatty acid ester reactants employed in step (A) of the process.

15. An additive of claim 1 wherein the amount of sulfur present in step (B) of the process is from about 20 to 100 parts by weight of sulfur per 100 parts of said dimer reactant employed in step (B) of the process.

16. An additive of claim 1 wherein step (B) is conducted in the presence of a sulfurization catalyst.

17. An additive of claim 16 wherein said sulfurization catalyst is an amine.

18. An additive of claim 17 wherein said amine is an alkylamine.

19. An additive of claim 18 wherein said alkylamine is a tert-alkyl primary amine.

20. An additive of claim 16 wherein said sulfurization catalyst is a compound selected from the group consisting of dimercaptothiadiazole, 2,5-dimercapto-1,3,4-thiadiazole, 2,5-bis(alkyldithio)-1,3,4-thiadiazole and 2-alkyldithio-5-mercapto-1,3,4-thiadiazole.

21. An additive of claim 20 wherein said compound is 2,5-dimercapto-1,3,4-thiadiazole.

22. An additive of claim 16 wherein said sulfurization catalyst is a combination of a tert-alkyl primary amine and 2,5-dimercapto-1,3,4-thiadiazole.

23. An additive of claim 16 wherein said sulfurization catalyst is present in an amount of from about 0.1–20 weight percent based on the total weight of the combined reactants employed in step (A) and step (B) of the process.

24. An additive of claim 22 wherein said catalyst is present in an amount of from about 0.1–20 weight percent based on the total weight of the combined reactants of step (A) and step (B) of the process.

25. A process for making a lubricating oil additive, said process comprising:

(A) in a first stage reacting at about 140°–180° C. a mixture comprising 100 parts by weight of at least one aliphatic olefinically unsaturated hydrocarbon containing from about 8 to 36 carbon atoms and about 1 to 160 parts by weight of at least one fatty acid ester with elemental sulfur to obtain an intermediate, and (B) in a second stage reacting at about 110° to 140° C. said intermediate with additional sulfur and from about 25 to 100 parts by weight based on the total weight of combined said aliphatic olefinically unsaturated hydrocarbon and fatty acid ester, a dimer of cyclopentadiene or lower $C_{1-4}$ alkyl substituted cyclopentadiene dimer.

26. A process of claim 25 wherein said olefinically unsaturated hydrocarbon is a monoolefinically unsaturated hydrocarbon.

27. A process of claim 26 wherein said monoolefinically unsaturated hydrocarbon is an α-olefin containing about 8 to 36 carbon atoms.

28. A process of claim 27 wherein said monoolefinically unsaturated hydrocarbon is at least one $C_{10-20}$ α-olefin.

29. A process of claim 28 wherein said monoolefinically unsaturated hydrocarbon is a mixture of $C_{14-16}$ α-olefins.

30. A process of claim 29 wherein said monoolefinically unsaturated hydrocarbon is a commercial mixture of $C_{14-16}$ α-olefins.

31. A process of claim 25 wherein said fatty acid ester is a fatty acid ester of a monohydric alcohol.

32. A process of claim 25 wherein said fatty acid ester is a fatty acid ester of a polyhydric alcohol.

33. A process of claim 32 wherein said fatty acid ester is at least one fatty oil.

34. A process of claim 33 wherein said oil is cottonseed oil.

35. A process of claim 25 wherein said fatty acid ester is present in an amount of from about 40 to 120 parts of fatty acid ester per 100 parts of said olefinically unsaturated hydrocarbon.

36. A process of claim 25 wherein the weight ratio of combined olefinically unsaturated hydrocarbon and fatty acid ester to sulfur in step (A) is between about 100:1 and 100:65.

37. A process of claim 25 wherein said lower $C_{1-4}$ alkyl substituted cyclopentadiene dimer is methylcyclopentadiene dimer.

38. A process of claim 25 wherein said dimer of cyclopentadiene or said lower $C_{1-4}$ cyclopentadiene dimer is present in an amount of from about 25 to 100 parts by weight of dimer based on the combined weight of said olefinically unsaturated hydrocarbon and said fatty acid ester reactants employed in step (A) of the process.

39. A process of claim 25 wherein the amount of sulfur present in step (B) of the process is from about 20 to 100 parts by weight of sulfur per 100 parts of said dimer reactant employed in step (B) of the process.

40. A process of claim 25 wherein step (B) is conducted in the presence of a sulfurization catalyst.

41. A process of claim 40 wherein said sulfurization catalyst is an amine.

42. A process of claim 41 wherein said amine is an alkylamine.

43. A process of claim 42 wherein said alkylamine is a tert-alkyl primary amine.

44. A process of claim 40 wherein said sulfurization catalyst is a compound selected from the group consisting of dimercaptothiadiazole, 2,5-dimercapto-1,3,4-thiadiazole, 2,5-bis(alkyldithio)-1,3,4-thiadiazole and 2-alkyldithio-5-mercapto-1,3,4-thiadiazole.

45. A process of claim 44 wherein said compound is 2,5-dimercapto-1,3,4-thiadiazole.

46. A process of claim 40 wherein said sulfurization catalyst is a combination of a tert-alkyl primary amine and 2,5-dimercapto-1,3,4-thiadiazole.

47. A process of claim 25 wherein said sulfurization catalyst is present in an amount of from about 0.1–20 weight percent based on the total weight of the combined reactants employed in step (A) and step (B) of the process.

48. A process of claim 46 wherein said catalyst is present in an amount of from about 0.1–20 weight percent based on the total weight of the combined reactants employed in step (A) and step (B) of the process.

49. A lubricating composition comprising a major portion of lubricating oil having a minor amount sufficient to impart antiwear and antioxidant properties of a lubricating additive prepared by the process comprising:

(A) in a first stage reacting at about 140°–180° C. a mixture comprising 100 parts by weight of at least one aliphatic olefinically unsaturated hydrocarbon containing from about 8 to 36 carbon atoms and about 1 to 160 parts by weight of at least one fatty acid ester with elemental sulfur to obtain an intermediate, and (B) in a second stage reacting at about 110°–140° C., said intermediate with additional sulfur and from about 25 to 100 parts by weight based on the total weight of combined said aliphatic olefinically unsaturated hydrocarbon and said fatty acid ester, a dimer of cyclopentadiene or lower $C_{1-4}$ alkyl substituted cyclopentadiene dimer.

50. A lubricating composition of claim 49 wherein said olefinically unsaturated hydrocarbon is a monoolefinically unsaturated hydrocarbon.

51. A lubricating composition of claim 50 wherein said monoolefinically unsaturated hydrocarbon is an α-olefin containing about 8 to 36 carbon atoms.

52. A lubricating composition of claim 51 wherein said monoolefinically unsaturated hydrocarbon is at least one $C_{10-20}$ α-olefin.

53. A lubricating composition of claim 52 wherein said monoolefinically unsaturated hydrocarbon is a mixture of $C_{14-16}$ α-olefins.

54. A lubricating composition of claim 53 wherein said monoolefinically unsaturated hydrocarbon is a commercial mixture of $C_{14-16}$ α-olefins.

55. A lubricating composition of claim 50 wherein said fatty acid ester is a fatty acid ester of a monohydric alcohol.

56. A lubricating composition of claim 50 wherein said fatty acid ester is a fatty acid ester of a polyhydric alcohol.

57. A lubricating composition of claim 56 wherein said fatty acid ester is at least one fatty oil.

58. A lubricating composition of claim 57 wherein said oil is cottonseed oil.

59. A lubricating composition of claim 50 wherein said fatty acid ester is present in an amount of from about 40 to 120 parts of fatty acid ester per 100 parts of said olefinically unsaturated hydrocarbon.

60. A lubricating composition of claim 50 wherein the weight ratio of combined olefinically unsaturated hydrocarbon and fatty acid ester to sulfur in step (A) is between about 100:1 and 100:65.

61. A lubricating composition of claim 50 wherein said lower $C_{1-4}$ alkyl substituted cyclopentadiene dimer is methylcyclopentadiene dimer.

62. A lubricating composition of claim 50 wherein said dimer of cyclopentadiene or said lower $C_{1-4}$ cyclopentadiene dimer is present in an amount of from about 25 to 100 parts by weight of dimer based on the combined weight of said olefinically unsaturated hydrocarbon and said fatty acid ester reactants employed in step (A) of the process.

63. A lubricating composition of claim 50 wherein the amount of sulfur present in step (B) of the process is from about 20 to 100 parts by weight of sulfur per 100 parts of said dimer reactant employed in step (B) of the process.

64. A lubricating composition of claim 50 wherein step (B) is conducted in the presence of a sulfurization catalyst.

65. A lubricating composition of claim 64 wherein said sulfurization catalyst is an amine.

66. A lubricating composition of claim 65 wherein said amine is an alkylamine.

67. A lubricating composition of claim 66 wherein said alkylamine is a tert-alkyl primary amine.

68. A lubricating composition of claim 64 wherein said sulfurization catalyst is a compound selected from the group consisting of dimercaptothiadiazole, 2,5-dimercapto-1,3,4-thiadiazole, 2,5-bis(alkyldithio)-1,3,4-thiadiazole and 2-alkyldithio-5-mercapto-1,3,4-thiadiazole.

69. A lubricating composition of claim 68 wherein said compound is 2,5-dimercapto-1,3,4-thiadiazole.

70. A lubricating composition of claim 64 wherein said sulfurization catalyst is a combination of a tert-alkyl primary amine and 2,5-dimercapto-1,3,4-thiadiazole.

71. A lubricating composition of claim 64 wherein said sulfurization catalyst is present in an amount of from about 0.1–20 weight percent based on the total weight of the combined reactants employed in step (A) and step (B) of the process.

72. A lubricating composition of claim 69 wherein said catalyst is present in an amount of from about 0.1–20 weight percent based on the total weight of the combined reactants of step (A) and step (B) of the process.

* * * * *